US005086251A

United States Patent [19]

Capek et al.

[11] Patent Number: 5,086,251

[45] Date of Patent: Feb. 4, 1992

[54] TENSION MASK CRT FRONT ASSEMBLY WITH REDUCED STRAIN-INDUCED DEFECTS

[75] Inventors: Raymond G. Capek, Elmhurst; Siegfried M. Greiner, Crystal Lake; Robert F. Hutton, Buffalo Grove, all of Ill.

[73] Assignee: Zenith Electronics Corporation, Glenview, Ill.

[21] Appl. No.: 458,129

[22] Filed: Dec. 28, 1989

[51] Int. Cl.[5] ..... H01J 29/81; H01J 29/07

[52] U.S. Cl. ..... 313/407; 313/408

[58] Field of Search ..... 313/402, 407, 408

[56] References Cited

U.S. PATENT DOCUMENTS

| | | | |
|---|---|---|---|
| 4,730,143 | 3/1988 | Fendley | 313/402 X |
| 4,745,328 | 5/1988 | Strauss | 313/408 X |
| 4,866,334 | 9/1989 | Fendley et al. | 313/408 X |
| 4,891,544 | 1/1990 | Capek et al. | 313/407 X |
| 4,891,545 | 1/1990 | Capek et al. | 313/407 X |
| 4,891,546 | 1/1990 | Dougherty et al. | 313/407 |

*Primary Examiner*—Donald J. Yusko
*Assistant Examiner*—Ashok Patel

[57] ABSTRACT

A tension mask color CRT has a mask support structure so composed, configured and arranged as to create an accurately controllable and widely variable compressive strain in prescribed critical areas of the faceplate inner surface which strengthens the bulb.

13 Claims, 3 Drawing Sheets

TENSION MASK CRT FRONT ASSEMBLY WITH REDUCED STRAIN-INDUCED DEFECTS

CROSS-REFERENCE TO RELATED APPLICATIONS

This application is related to but in no way dependent upon copending applications Ser. No. 269,822, filed Nov. 10, 1988 (now U.S. Pat. No. 4,891,546), and Ser. No. 178,175, filed Apr. 16, 1988 (now U.S. Pat. No. 4,891,545), both of common ownership herewith.

BACKGROUND OF THE INVENTION

1. Field of the Invention

This invention relates to color cathode ray picture tubes, and is addressed specifically to an improved front assembly for color tubes having shadow masks of the tension foil type in association with a substantially flat faceplate. The invention is useful in color tubes of various types, including those used in home entertainment television receivers, and in medium-resolution and high-resolution tubes intended for color monitors.

The use of the foil-type flat tension mask and flat faceplate provides many benefits in comparison to the conventional domed shadow mask and correlatively curved faceplate. Chief among these is a greater power-handling capability which makes possible as much as a three-fold increase in brightness. The conventional curved shadow mask, which is not under tension, tends to "dome" in picture areas of high brightness where the intensity of the electron beam bombardment is greatest. Color impurities result as the mask moves closer to the faceplate, and as the beam-passing apertures move out of registration with their associated phosphor elements on the faceplate. When heated, the tension mask distorts in a manner quite different from that of the conventional mask. If the entire mask is heated uniformly, there is no doming and no distortion until tension is completely lost; just before that point, wrinkling may occur in the corners. If only portions of the mask are heated, those portions expand, and the unheated portions contract, resulting in displacements within the plane of the mask; i.e., the mask remains flat.

The tension foil shadow mask is a part of the cathode ray tube front assembly, and is located in close adjacency to the faceplate. The front assembly comprises the faceplate with its screen consisting of deposits of light-emitting phosphors, a shadow mask, and support means for the mask. As used herein, the term "shadow mask" means an apertured metallic foil which may, by way of example, be about 0.001 inch thick, or less. The mask must be supported in high tension a predetermined distance from the inner surface of the cathode ray tube faceplate; this distance is known as the "Q-distance." As is well known in the art, the shadow mask acts as a color-selection electrode, or parallax barrier, which ensures that each of the three beams generated by the electron gun located in the neck of the tube lands only on its assigned phosphor deposits.

The requirements for a support means for a foil shadow mask are stringent. As has been noted, the foil shadow mask is normally mounted under high tension; e.g., 30 lb/inch. The support means must be of high strength so the mask is held immovable; an inward movement of the mask of as little as 0.0002 inch can cause the loss of guard band. Also, it is desirable that the shadow mask support means be of such configuration and material composition as to be compatible with the means to which it is attached. As an example, if the support means is attached to glass, such as the glass of the inner surface of the faceplate, the support means must have a coefficient of thermal contraction compatible with that of the glass, and by its composition, be bondable to glass. Also, the support means must be of such composition and structure that the mask can be secured to it by production-worthy techniques such as electrical resistance welding or laser welding. Further, it is essential that the support means provide a suitable surface for mounting and securing the mask. The material of which the support structure is composed must be adaptable to machining or to other forms of shaping so the structure can be contoured into near-perfect flatness. Otherwise, voids will exist between the metal of the mask and the support structure, preventing positive, uniform contact of the mask to the support structure necessary for proper mask securement.

In the manufacture of a front assembly for a flat tension mask color cathode ray tube, a rail or other member for supporting the shadow mask in tension may be secured to the inner surface of the glass faceplate by a devitrifiable solder glass, sometimes herein termed "frit." The frit is applied between the mask support structure and the faceplate inner surface. The faceplate assembly is elevated in temperature in an oven called a "lehr" which raises the temperature of the assembly to or above the temperature at which the frit devitrifies (crystallizes). At that elevated temperature, the mask support structure becomes rigidly affixed to the faceplate inner surface. As the assembly is cooled, any differential between the net CTC (coefficient of thermal contraction) of the mask support structure and the faceplate glass will create strains in the mask support structure and the glass at their interface. As glass is strong in compression but weaker in tension, there is always the concern that any thermal coefficient mismatch between the mask support structure and the glass will create spalling (tearing away of glass) in the interface area, initiation and propagation of cracks, separation of the mask support structure from the faceplate inner surface, and other such thermal-strain-related defects.

These strains are not so apt to cause problems on a thermal downcycle such as is encountered after devitrification of the frit, as described, since during cool-down, the exterior of the faceplate is cooler than the interior, causing the outer surface of the glass to contract more rapidly than the inner surface. The result of this thermal imbalance is to cause the external surface of the glass to go into tension, and the internal surface of the glass (to which the mask support structure is attached) to go into compression.

Glass in compression is relatively strong and the aforedescribed thermal strain-related defects are not common. However, when the bulb is evacuated, it is again heated to an elevated temperature. Unlike the earlier-described thermal up-cycle wherein the frit was in a liquid state, in this stage of tube fabrication, the mask support structure is rigidly locked to the faceplate inner surface by the devitrified frit. As the bulb exterior is heated, the outside surface of the bulb is placed in compression and the inside surfaces, including the faceplate inner surface to which the mask support structure is secured, are placed in tension. These tensile strains induced in the inner surface of the faceplate will add to any pre-existing tensile strains attributable to a mismatch between the CTC of the mask support structure and the CTC of the faceplate glass.

Such accumulated tensile strain is further augmented by the atmospheric loading on the bulb exterior, particularly the flat faceplate. The effect of these tensile-strain-producing stresses combines to impose limitations on the thermal gradient that the bulb can withstand during tube evacuation and thus on the unit through-put in the evacuation stage.

A cathode ray tube bulb will have in a particular area a strain limit beyond which it is apt to fail. The most critical area on the inner surface of the faceplate has been found to be adjacent the end of the mask support structures wherein there exists bulb shape irregularities, frit-to-glass interfaces, mask support structure terminations, etc. It is important, therefore, that the strain limit in that critical area not be exceeded A mask support structure which is currently in commercial use by the assignee of the present invention is described in U.S. Pat. No. 4,891,545, of common ownership herewith. The mask support structure described therein comprises a hollow metal trough, the interior of which is filled with conventional color CRT frit, such as Owens Illinois T540 or Corning 7580 series. Frit is used because of its known compatibility with CRT vacuum environments and its neutrality in thermal coefficient with respect to glass. Conventional color CRT frit has a CTC of about $98\times10^{-7}$ in./in /degree C. The composition of the metal trough is selected to have a CTC most closely approximating that of glass. The preferred material is Alloy No. 27 manufactured by Carpenter Technology, Inc. of Reading, Pa. Alloy No. 27 has a CTC of approximately $108\times10^{-7}$ in./in./degree C. The mask support structure, representing a combination of frit having a CTC slightly lower than conventional color CRT glass (about $100\times10^{-7}$ in./in./degree C.) combined with a Carpenter Alloy No. 27 trough, produces a mask support structure having a net CTC which closely approximates the CTC of the faceplate glass. Such a "filled trough" mask support structure can be said to be essentially thermally matched or neutral with respect to the faceplate glass.

It should be noted that conventional color CRT frit has a CTC which is slightly less than the CTC of typical color CRT faceplate glass in order that when used in its customary application to seal a CRT glass funnel (having a CTC of approx. $99.5\times10^{-7}$ in /in./degree C.) and a faceplate (having a CTC typically about of $100\times10^{-7}$ in./in/degree C.), the frit will, upon devitrification and cool-down, be placed in compression and thus be stronger than if in tension.

Measurements have been taken of the deflection of a faceplate at various points along a system of mask support structures of the before-described "filled trough" type. (Deflection of a faceplate is indicative of residual strain.) Results of such tests reveal that the stresses imposed on the faceplate by such "filled trough" systems are approximately neutral (about 1200 psi or less), but slightly negative—i.e., in a direction indicating that the frit at the interface between the mask support structure and the glass is in compression (producing a strong frit bond, as desired) and the strain imposed on the glass at the interface is slightly tensile. The sought-after neutrality is essentially achieved by such an arrangement. In summary, following conventional wisdom, the existing commercial flat faceplate color CRT has a mask support structure which is essentially neutral with respect to the faceplate in terms of the CTC's of the mask support structure and the faceplate.

However, the aforedescribed "filled trough" mask support system has a number of shortcomings. First, it has been found to be a thermally "weak" bulb in the sense that it must be heated and cooled at slow rates to keep the tensile strains induced on the inner surface of the faceplate, particularly in the critical areas near the ends of the mask support structure, below the maximum strain tolerance of the bulb. At more acceptable through-put rates, it has been found that cracks develop across the corners of the faceplate near the ends of the mask support structures.

Second, due to the extreme CTC mismatch between the metal trough and the faceplate inner surface, spalling occurs in the sub-structure glass surface—that is, in the area of interface between the mask support structure and the faceplate inner surface—when the front assembly is subjected to thermal shocks. Bond failures, even strip-off of the mask support structure, can also result. Thermal shocking of the faceplate occurs, e.g., during screen fabrication when the screen surface is washed with a caustic solution at elevated temperature (60 degrees C., for example), or when it is washed with cool water when in a warm state.

Third, such thermal shocking has also been found to produce microfissures in the body of the frit filling the trough. These microfissures are believed to be caused by the extreme thermal mismatch between the metal trough and the contained frit material. Such microfissures in the frit material result in contamination of the vacuum environment within the CRT envelope after pump-down and seal-off, due to outgassing from the microfractured frit.

Alternate prior art mask support structures are disclosed in U.S. Pat. Nos. 4,737,681 and 4,745,330, both of common ownership herewith.

The '681 patent describes a mask support structure comprising a ceramic rail, on the distal edge of which is secured a metal cap providing a substrate to which a shadow mask can be welded under tension. Various configurations of ceramic rails and caps are illustrated. The ceramic element is characterized as a "buffer strip" preferably composed of a ceramic material. Quoting, "The ceramic material according to the invention is characterized by having a thermal coefficient of expansion substantially equal to the coefficient of the glass of the faceplate. The ceramic could as well have a coefficient intermediate to the coefficients of the glass and the metal hoop [the cap] effective to absorb the stresses produced due to the differing expansion and contraction coefficients of the glass and the metal hoop." (Col. 6, lines 17-37.) By way of example, the thermal coefficient of the metal cap or hoop is given as $108\times10^{-7}$ in./in /degree C.; the ceramic element is described as having a CTC of $105\times10^{-7}$ in./in./degree C. and the glass is said to have a CTC of $106\times10^{-7}$ in /in./degree C.

Thus the mask support structure, having a ceramic element whose CTC is substantially equal to or intermediate to the coefficients of expansion of the glass and the metal cap would have a net CTC which is equal to or greater than that of the glass.

The later-filed '330 patent discloses a mask support structure comprising multiple layers of ceramic material of different CTC's, on the distal edge of which (remote from the faceplate inner surface) is secured a metal cap serving as a weldable substrate for attachment of the tensioned shadow mask by laser welding. The '330 patent teaches the utilization of such a structure to buffer the CTC differential between the metal, preferably Carpenter's metal, and the supporting glass surface.

Specifically, a ceramic element interfacing with the faceplate glass has a CTC equal to or higher than that of the glass. Another ceramic element interfacing with a weldable metal cap has a CTC no greater than that of the cap. Certain disclosed embodiments have one or more additional ceramic elements with CTCs between these two.

One example disclosed in the '330 patent is a three-layer ceramic system in which the element interfacing with the faceplate has a CTC of about $103\times10^{-7}$ in./in /degree C. The next layer (away from the faceplate) has a CTC of about $105\times10^{-7}$ in./in./degree C. The third ceramic layer has a CTC of about $107\times10^{-7}$ in./in./degree C. The metal cap has a CTC of about $108\times10^{-7}$ in./in./degree C.

As described therein, the ceramic material may have a composition known as forsterite (magnesium silicate). The metal cap is Carpenter Alloy No. 27 which has a CTC of $108\times10^{-7}$ in./in./degree C. The forsterite composition can be changed by varying the composition of the ceramic. The '330 patent states that "the ceramic shadow mask support structure must provide a CTC of 100 to $110\times10^{-7}$ in./in/degree C. to satisfy the CTC's of both the glass and the metal." In other words, the multi-layered ceramic mask support system is designed to buffer the very different CTC's of the glass and metal cap. The net CTC of the entire mask support structure would be significantly above the CTC of the glass.

Thus the '681 and '330 patents teach mask support structures which conform to the conventional wisdom of matching as closely as possible the CTC of components and glass which are affixed together in order to prevent glass defects due to strains induced by thermal coefficient mismatches.

In such suggested prior art structure, it is disclosed that by choosing the CTC of the mask support structure to be between the CTC of the faceplate glass and the weldable metal cap, a favorable buffering effect would result. The use of a mask support structure having such an intermediate CTC, however, has the effect of placing the faceplate glass beneath the structure in compression whenever the assembly is brought down in temperature from a high processing temperature.

It has been discovered that setting up a condition of compression in the sub-structure glass may be the cause of the aforedescribed glass failures. This is because, it is believed, when the sub-structure glass surface has been placed in compression, the marginal glass surface areas adjacent the ends of the mask support structures are placed in tension at the end of a cool-down phase. It is this tension in the marginal areas of the glass adjacent the ends of the mask support structure which is believed to cause the destructive glass cracks.

In accordance with the teachings of this invention, as will be described in detail hereinafter, the marginal areas of the faceplate surface immediately adjacent the ends of the mask support structures are placed in compression to thwart the initiation of glass cracks which could result in glass failures. In order to place these marginal faceplate surface areas in compression, in accordance with a preferred form of this invention, the sub-structure faceplate surface is placed in tension. This is done by causing the mask support structures to have a CTC significantly lower than that of the faceplate glass.

However, by the use of a mask support structure having a CTC significantly lower than that of the supporting faceplate glass, there exists the possibility that spalling or other strain-related glass defects may occur at or near the interface of the faceplate glass and the mask support structure.

A second concern involves the difficulty in fine tuning the net CTC of the mask support structure to achieve the exact level of strain desired to exist in the sub-structure faceplate glass.

As will be explained below, in the preferred form of the invention, the mask support structure is composed of fosterite ceramic and its CTC is controlled by varying the content of MgO in the composition.

However a small change in the MgO content produces a relatively large change in CTC. In a mass production environment it is difficult to consistently obtain a ceramic mask support structure having the exact CTC desired by varying the MgO content of a fosterite composition.

In accordance with an aspect of this invention, both of these concerns having to do with the CTC of the ceramic mask support structure (i.e., mismatch to glass and CTC control) are answered—first by the use of a cement having a CTC intermediate that of the ceramic element and the faceplate, and the second, by the provision of a controlled cross-section recess or groove in the base of the ceramic element.

The cement, provided in a controlled amount (by virtue of the recess), 1) buffers the CTC mismatch between the glass and the mask support structure, and 2) fine-tunes the net CTC of the mask support structure.

PRIOR ART

Other prior art: U.S. Pat. Nos. 4,704,094—Stempfle; 4,026,811—Readey et al; 4,745,330—Capek et al; 4,737,681—Dietch et al; 4,730,143—Fendley; and 4,779,023—Strauss.

OBJECTS OF THE INVENTION

It is a general object of the invention to provide a tension mask color cathode ray tube having an improved front assembly.

It is another object of this invention to provide such a CRT in which the front assembly is so composed, constructed and arranged as to overcome the aforedescribed problem of glass failures due to cracks propagating from the terminations of the mask support structures.

It is another object to provide a color CRT having such a front assembly which has reduced susceptibility to yield losses due to spalling and outgassing.

It is still another object to provide such a color CRT which can readily be adjusted to accomodate faceplate glass of differing compositions, and differing CRT design and/or production objectives such as maximized throughput, maximized yield, varying tube size, etc.

It is another object of this invention to provide a tension mask color CRT having a faceplate assembly that permits the use of higher thermal gradients during tube evacuation, with resulting greater yields and/or throughput and consequent reduced manufacturing costs.

It is yet another object to provide such a CRT by which the desired tensile strain at the interface of the mask support structure and faceplate glass can be accurately controlled in a mass production environment.

BRIEF DESCRIPTION OF THE DRAWINGS

The features of the present invention which are believed to be novel are set forth with particularity in the appended claims. The invention, together with further objects and advantages thereof, may be best understood by reference to the following description taken in conjunction with the accompanying drawings (not to scale), in the several figures of which like reference numerals identify like elements, and in which:

DESCRIPTION OF THE PREFERRED EMBODIMENT

Figure 1:
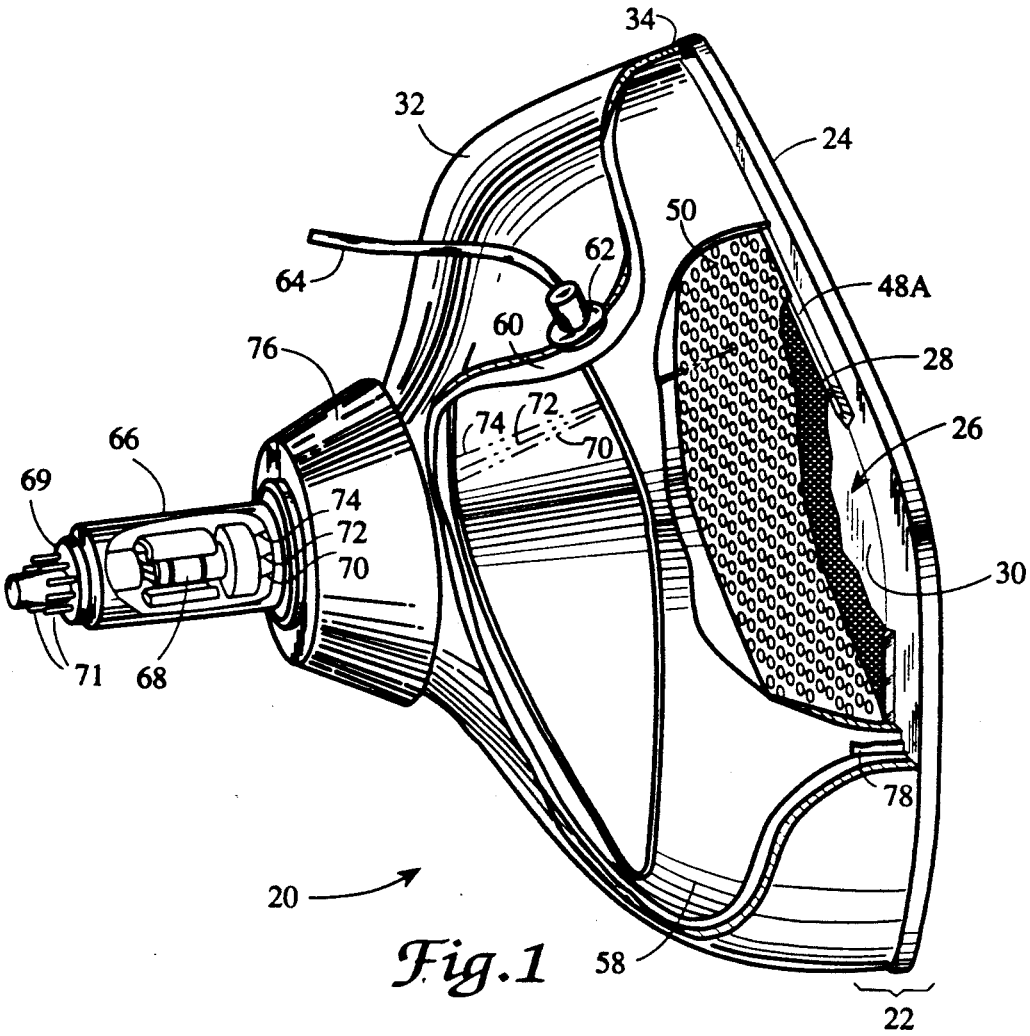
FIG. 1 is a side view in perspective of a color cathode ray tube and front assembly having an improved shadow mask support structure according to the invention, with cut-away sections that indicate the location and relation of the structure to other major tube components.

This invention makes a radical departure from accepted principles of glass-to-non-glass interfaces, availing a discovery that a stronger bulb and an improved system overall results if the net CTC of the mask support structure is deliberately mismatched to the CTC of the glass. Specifically, by this invention the net CTC of the mask support structure is made significantly below that of the faceplate glass.

While this contradicts known glass-to-non-glass thermal coefficient matching principles, it has proven to result in dramatically improved flat tension mask color cathode ray tube products. This deliberate negative CTC mismatch at the interface of the mask support structure and the glass faceplate produces a significant design tensile pre-stress on the substructure glass which yields a number of important benefits. (Introduction of strains in glass, particularly tensile strains, would ordinarily be avoided at all cost.)

First, tests have shown that a significantly improved production throughput rate results, due to an ability to shorten the thermal cycle in the evacuation stage. Stated another way, a tube with a deliberately negatively mismatched CTC at the interface of the mask support structure and faceplate glass will tolerate a significantly higher thermal gradient without glass failures occurring. By way of example, with prior "filled trough" mask support structures, a thermal gradient of approximately 9–10 degrees centigrade per minute could be tolerated. With the present invention, a thermal gradient of approximately 13–14 degrees centigrade per minute can be tolerated. This represents an improvement in production throughput of 30 percent which, in turn, translates into significantly reduced manufacturing costs.

The reason for the improvement will be explained. In the previous "filled trough" system, tensile strains are introduced in the inner surface of the faceplate glass which are particularly acute in the regions adjacent to the ends of the mask support structures. Those existing strains, when added to the thermal strains introduced during thermal upcycling of the CRT, as occurs during CRT evacuation, exacerbated by atmospheric loading on the faceplate, not infrequently create total strains in excess of the tolerable strain limit of the CRT faceplate in those regions, with consequent glass failures.

In accordance with the present invention, a strain in the opposite sense is introduced into the glass inner surface in the critical regions around the end of the mask support structures. Upon thermal cycling of the tube, the strains introduced by the heating of the outside of the tube and atmospheric loading, are in part offset by the oppositely directed strains pre-existing in the inner surface glass as a result of the deliberate CTC mismatching of glass and mask support structure.

The result is that higher thermal gradients may be tolerated by the CRT during its fabrication, or, alternatively, for a given thermal gradient the resulting yield will be significantly higher.

It should be noted that the prior "filled trough" system cannot be utilized to achieve the results of the present invention. First, the CTC of the frit material used to fill the trough is limited to approximately $97\text{–}98 \times 10^{-7}$ in./in./degree C. Even if frit with a CTC significantly below that of the glass were capable of being developed or obtained, such could not be utilized, since such would create an even greater thermal mismatch between the frit and the enveloping trough, resulting in an exacerbated outgassing problem.

It has been found that whereas the deliberate mismatch between the net CTC of the mask support system and the supporting faceplate glass might be achieved by the use of other materials and support configurations, at the present time it is believed that the preferred execution is by means of a ceramic element or "rail" which is secured directly to the faceplate inner surface by means of a frit cement. On the distal edge of the ceramic rail is located a metal cap to which the shadow mask is welded.

A color cathode ray tube and a faceplate assembly according to the invention having an improved structure for supporting a tensed foil shadow mask is depicted in FIG. 1. The tube and its component parts are identified in FIGS. 1 and 2, and described in the following paragraphs in this sequence: reference number, a reference name, and a brief description of structure, interconnections, relationship, functions, operation, and/or result, as appropriate.

20: color cathode ray tube according to the invention
22: faceplate assembly according to the invention
24: glass faceplate
26: inner surface of faceplate
28: centrally disposed phosphor screen
30: film of aluminum
32: funnel
34: peripheral sealing area of faceplate 24, adapted to mate with the peripheral sealing area of funnel 32

48: shadow mask support structure according to the invention indicated as being located on opposed sides of the screen 28 for receiving and securing a tensed foil shadow mask 50: metal foil shadow mask; after being tensed, the mask is mounted on support structure 48 and secured thereto shadow mask apertures, indicated as greatly enlarged in the inset for illustrative purposes 58: internal magnetic shield 60: internal conductive coating on funnel 62: anode button 64: high-voltage conductor 66: neck of tube 68: in-line electron gun providing three discrete in-line electron beams 70, 72 and 74 for exciting the respective red-light-emitting, green-light-emitting, and blue-light-emitting phosphor deposits on screen 28

69: base of tube

71: metal pins for conducting operating voltages and video signals through base 69 to electron gun 68

76: yoke which provides for the traverse of beams 70, 72 and 74 across screen 28

78: contact spring which provides an electrical path between the funnel coating 60 and the mask support structure 48

Figure 2:
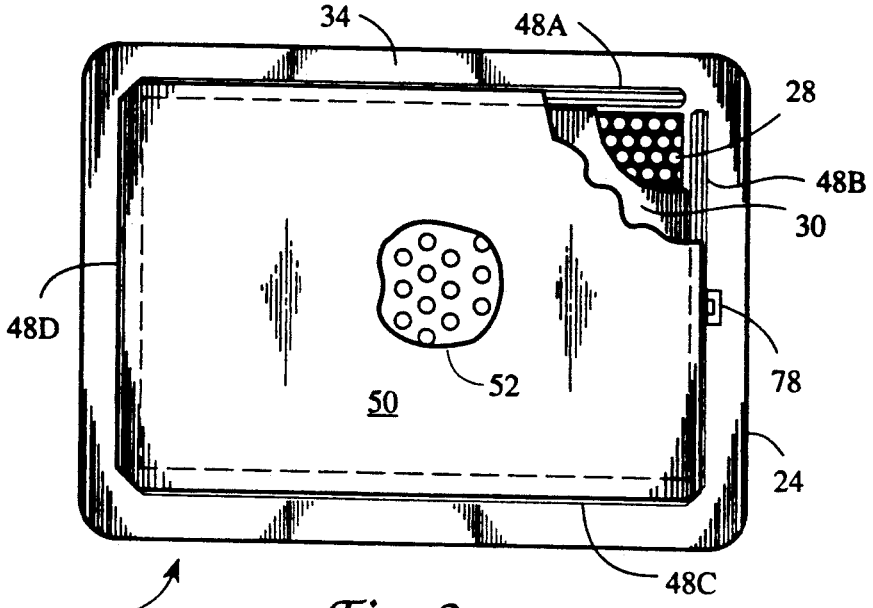
FIG. 2 is a plan view of the front assembly of the tube shown by FIG. 1, with parts cut away to show the relationship of the embodiment of the mask support structure shown by FIG. 1 with the faceplate and the shadow mask; an inset depicts mask apertures greatly enlarged.

As indicated by FIGS. 1 and 2, color cathode ray tube 20 has a front assembly 22 comprising a faceplate 24 having a tensed foil shadow mask 50 supported by a mask support structure 48.

Figure 3:
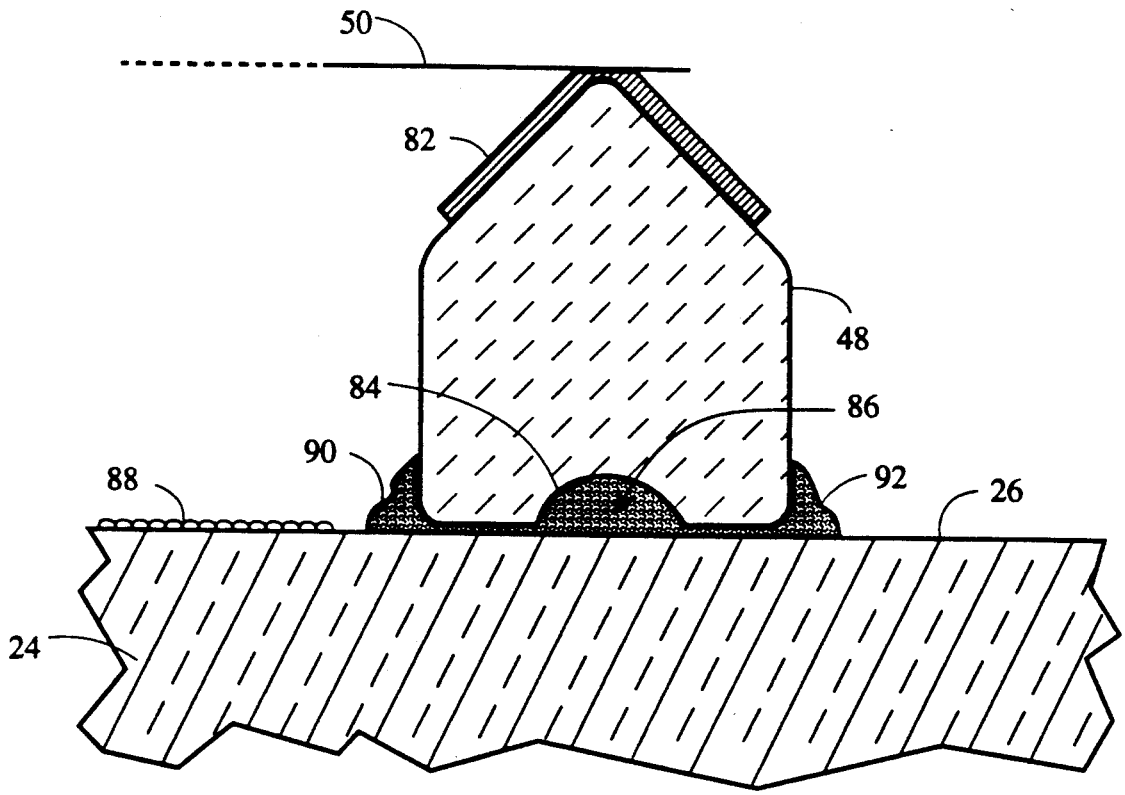
FIG. 3 is a cross-sectional view in elevation of a tension mask support structure according to the invention depicted in FIGS. 1 and 2; the structure is indicated as being secured to a faceplate.

With reference now to FIG. 3, support structure 48, according to the invention, is depicted. The general configuration of the mask support structure shown is the subject of referent U.S. Pat. No. 4,891,546 of common ownership. Structure 48 is depicted symbolically as comprising a body of ceramic secured to faceplate 24 adjacent a cathodoluminescent screen 88, and with a saddle of metal 82 indicated as receiving and securing a metal foil mask 50 mounted in tension, all as fully described and claimed in the reference U.S. Pat. No. 4,891,546.

In accordance with the present invention, mask support means are provided which are secured on opposed sides of the target area on the inner surface of the faceplate for receiving and retaining the shadow mask 50. The mask support means are constructed and arranged such that the faceplate glass at the interface with the mask support means is placed under significant tensile strain, as will be described in more detail hereinafter.

The aforesaid tensile strain at the interface of the mask support structure and the faceplate is produced by causing the mask support means to have a net thermal contraction coefficient which is lower than the thermal coefficient of the faceplate glass such that after devitrification of the solder glass at an elevated temperature to affix the mask support means to the faceplate, and subsequent cool-down, faceplate glass at the interface with the mask support means is placed under significant tensile strain.

Although a variety of mask support structures might be devised to accomplish the aforesaid imposition of the tensile-strain-producing stresses, the illustrated preferred embodiment is shown as comprising a ceramic-metal laminate structure having a ceramic element in contact with the glass and a metal element to which the mask may be welded which is affixed at the opposed distal edge of the ceramic element.

The ceramic mask support structure 48, the glass of faceplate 24, and the solder glass used to secure the structure to the faceplate, comprise a "system" in which the properties of each component interact with the others. Although contradicting conventional wisdom, experimentation has shown that "prestressing" the glass faceplate will permit it to better withstand the temperature excursions which the system experiences during production (room temperature to about 460 degrees C.).

It is an object of the present invention to provide a flat tension mask color CRT having a front assembly which can be adjusted to accommodate varying faceplate glass compositions, tube sizes, etc., and differing design and/or production objectives. This is achieved by varying the stress-producing properties of the mask support structure. In the illustrated embodiment which utilizes a forsterite ceramic mask support rail, the MgO content is varied to adjust the CTC of the rail and thus the stress imposed upon the faceplate.

Figure 4:
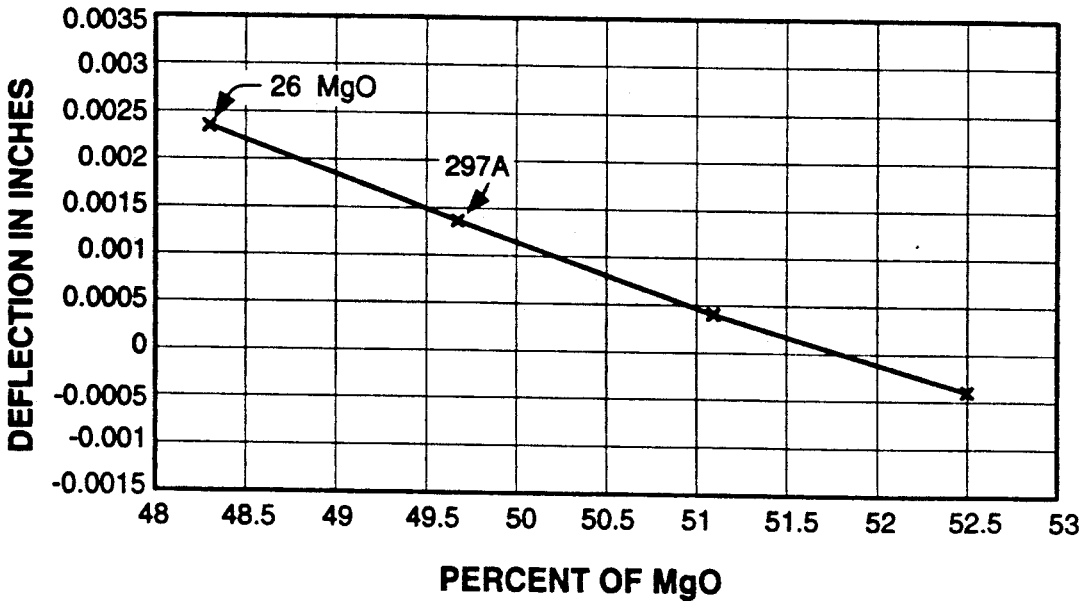
FIG. 4 is a plot of maximum faceplate deflection with MgO composition of the forsterite mask support structures.

FIG. 4 is a plot showing maximum faceplate ("panel") deflection as a function of MgO content in the rails, as measured along one of the longer rails. The relationship is substantially linear, providing an extremely flexible, accurate and useful tool for selecting the amount faceplate strain to be developed.

As discussed above, this invention recognizes the fact that during evacuation, the tube is heated to relatively high temperatures, which, during the thermal up-cycle, places the inner surface of the bulb under tension. Furthermore, because the tube is being evacuated at that time, the atmospheric loading on the faceplate adds to the tensile strains imposed on the inner surface of the bulb. The accumulation of these two contributing factors will add to any faceplate inner surface tensile strain existing in the region of the mask support structures, particularly near the ends thereof. The result is that the tolerance of the bulb for tensile strain is apt to be exceeded during tube evacuation.

As will be understood from this description, by establishing compressive strains in the critical region of the faceplate inner surface adjacent to the ends of the mask support structures, by appropriate choice of the net thermal contraction coefficient of the mask support structure, the tensile strain increments introduced by the atmospheric loading and thermal cycling of the tube are partially offset. The result is that faster thermal cycle rates can be tolerated for a given yield, or for a given thermal cycle time, greater yields will be achieved.

In accordance with an aspect of this invention, in order that the net CTC of the mask support structure will be lower than that of the faceplate glass, the CTC of the ceramic element must be very significantly lower than the CTC of the faceplate glass—specifically sufficiently lower to product strain in the sub-support-structure glass of at least 2000 psi. Accurate and consistent CTC measurements of the ceramic mask support element are difficult to obtain, however, we believe a glass strain of 2000 psi or more represents a CTC differential of at least 3 points. By way of example, as noted above, the coefficient of thermal contraction of typical color CRT glass is $100\times10^{-7}$ in./in./degree C. As aforedescribed, the preferred composition of the metal cap is Carpenter's metal Alloy No. 27 having a thermal coefficient of about $108\times10^{-7}$ in./in. degree C. In accordance with this invention, the composition of the ceramic element of rail is such that the ceramic element has a thermal coefficient no greater than $97\times10^{-7}$ in./in./degree C.

Figure 5:
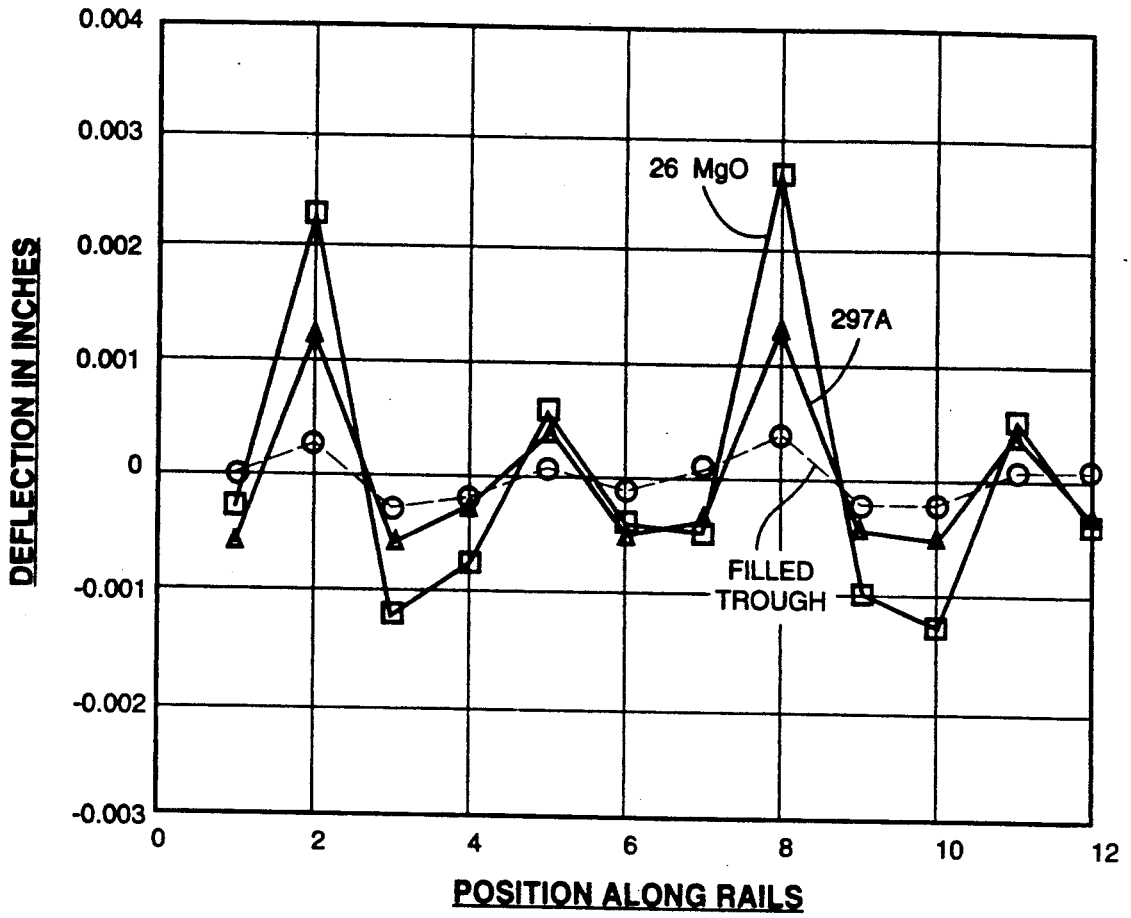
FIG. 5 is a plot of faceplate deflection for two mask support systems practicing the invention and one prior art system.
Figure 6:
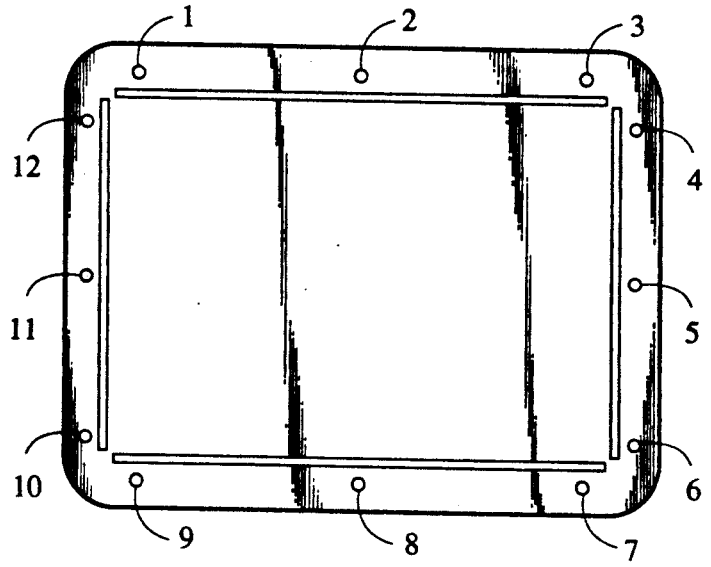
FIG. 6 is a diagram showing measurement points referenced in the FIG. 5 plot.

FIG. 5 is a plot of faceplate (panel) deflection at various points around a 4-rail mask support system. FIG. 6 indicates the location on the faceplate of test points 1 through 12 indicated in FIG. 5. The test points are located immediately outside of the rails and outside the solder glass fillets. The location of the test points is the result of measurements that indicated that the greatest deflection of the faceplate from stress caused by the rail attachment is adjacent to the rails.

| Preferred Composition of Ceramic Rail | | |
|---|---|---|
| | Designation 297A | Designation 26 MgO |
| Talc ($MgO + SiO_2$) | 62% | 64% |
| Magnesia (MgO) | 28% | 26% |
| Ball Clay | 4% | 4% |
| Barium Carbonate | 6% | 6% |
| | 100% | 100% |
| (Total MgO) | 49.7% | 48.3% |

The curve designated "filled trough" depicts the deflection produced by the afore-described prior art mask support system comprising metal troughs filled with commercial color CRT frit.

The plot clearly reveals the very significant deflection of the faceplate by the two ceramic rail systems, 26 MgO and 297A, following the teachings of the present invention, and the relatively neutral effect of the prior "filled trough" system. The tensile strain in the sub-rail glass for a 297A ceramic rail has been measured at 1290 psi; for a 26 MgO rail it was 2700 psi. This compares with only 1200 psi max for the prior "filled trough" system. The slight stressing of the faceplate by the prior filled rail system is effective to put the frit in compression, but insufficient to produce a bulb as strong as desired. The strength of the bulb can not be improved using the prior filled rail system for the reasons given above, and no flexibility is afforded to adjust for varying faceplate compositions or tube sizes, or different design and/or production objectives.

As stated, by this invention a deliberate thermal coefficient mismatch is created between the mask support structure and the underlying faceplate glass, necessitating (because of the high thermal coefficient of the metal element) that the thermal coefficient of the first (ceramic) element have a substantial mismatch with respect to the glass with which it interfaces. To alleviate any problems which might occur due to the mismatch between the glass and the ceramic element, the cement used to secure the first element (in this embodiment, ceramic) to the glass inner surface is employed to produce a buffering effect.

The buffering effect introduced by the cement between the ceramic element and the glass is linearly proportional to the thickness and to its thermal coefficient. Specifically, studies have shown that the tensile stress imposed by the frit cement is linearly proportional to solder glass thickness in seal thicknesses ranging from 0.003 inch to 0.120 inch.

The seal between the ceramic element and the faceplate glass is subject to conflicting requirements. First, in order that the "Q" distance from the top of the metal element to the faceplate inner surface be maintained at a very precise value, it is desirable that the thickness of the cement be held constant at about 0.005+/−0.001 inch. On the other hand, a cement thickness of only 0.005 inch is insufficient to produce the required or desired buffering effect.

In accordance with an aspect of this invention, the conflicting objectives of providing a sufficient quantity of cement at the interface between the ceramic element and the glass to provide effective buffering, and yet an amount insufficient to diminish control of "Q" distance, are achieved by providing a longitudinal recess or groove 84 in the first element (the ceramic element, in this case), and by utilizing a cement 86 having a CTC intermediate that of the ceramic rail and the faceplate glass. The cement is preferably standard color CRT frit having a CTC typically about $98\times10^{-7}$ in./in./degree C.

The greater the cross-sectioned area of the groove 84, and thus the greater the volume of frit, the greater will be the buffering effect.

As alluded to above, the frit-filled groove also serves to fine tune the net CTC of the mask support structure. The greater the groove cross-section (and thus frit quantity), the greater will be the net CTC of the mask support structure. The strong negative net CTC of the mask support structure will thus be made less negative, i.e., it will be increased in the direction toward the faceplate CTC.

Thus, the cross-sectional area of the groove can be tailored to provide a controlled incrementing of the net CTC of the mask support structure.

By way of example, if it were desired in a given application to use as the ceramic rail composition 26 MgO, but the resulting differential between the net CTC of the mask support structure and the faceplate glass CTC (and the resulting faceplate strains) were too great, the CTC differential could be reduced by providing a rail groove 84 of appropriate cross-sectional area and configuration.

Fillets 92 and 90, which serve to secure support structure 48 to faceplate 24, are indicated as also comprising frit.

Groove 84, depicted as having the configuration of a partial cylinder, may as well comprise, by way of example, a slot with a rounded top, or it may have an elliptical shape. Whatever its shape, the depth of the groove may typically range from 0.01 to 0.090 inch. One successful execution has a groove cross-section which is 0.030 inch deep and 0.075 inch wide in the form of a half oval in a rail having an interface width of about 0.220 inch.

The lengthwise groove according to the invention is additionally beneficial in that it provides a uniform channel for receiving the devitrifying solder glass when it is in paste form, providing for a very straight bead with uniform seal thickness and fillet geometry.

While a particular embodiment of the invention has been shown and described, it will be readily apparent to those skilled in the art that changes and modifications may be made in the inventive means without departing from the invention in its broader aspects, and therefore, the aim of the appended claims is to cover all such changes and modifications as fall within the true spirit and scope of the invention.

We claim:

1. A flat tension mask color cathode ray tube having a front assembly comprising:

a faceplate having an inner surface with a target area for receiving a cathodoluminescent screen, said faceplate being composed of a glass having a predetermined thermal coefficient of thermal contraction; and a mask support structure secured by devitrifiable solder glass on opposed sides of said target area for receiving and retaining a foil shadow mask in tension at a predetermined distance from said inner surface, said mask support structure having a net coefficient of thermal contraction which is lower than said predetermined coefficient of thermal contraction of said faceplate glass, such that after devitrification of said solder glass at an elevated temperature to affix said mask support structure to said faceplate, and subsequent cool-down, glass under said mask support structure is placed under significant tensile strain to increase the resistance of the cathode ray tube faceplate to defects attributable to thermal gradients in the region of said mask support structure.

2. A flat tension mask color cathode ray tube having a front assembly comprising:

a faceplate having an inner surface with a target area for receiving a cathodoluminescent screen, said faceplate being composed of a glass having a predetermined thermal contraction coefficient; and mask support means secured by devitrifiable solder glass on opposed sides of said target area for receiving and retaining a foil shadow mask in tension at a predetermined distance from said inner surface, said mask support means having a net thermal contraction coefficient which is lower than said predetermined glass coefficient by a coefficient differential value which is such that after devitrification of said solder glass at an elevated temperature to affix said mask support means to said faceplate, and subsequent cool-down, faceplate glass at the interface with said mask support means is placed under significant tensile strain.

3. A flat tension mask color cathode ray tube having a front assembly comprising:

a faceplate having an inner surface with a target area for receiving a cathodoluminescent screen, said faceplate being composed of a glass having a predetermined thermal contraction coefficient; and mask support means secured by cement on opposed sides of said target area for receiving and retaining a foil shadow mask in tension at a predetermined distance from said inner surface, said mask support means comprising a laminate with a first element between the faceplate glass and a second element, said first element having a contraction coefficient lower than that of the faceplate glass and said second element having a contraction coefficient higher than that of said faceplate glass, said mask support means having a net thermal contraction coefficient which is lower than said predetermined glass coefficient such that after devitrification of said cement at an elevated temperature to affix said mask support means to said faceplate, and subsequent cool-down, faceplate glass at the interface with said mask support means is placed under significant tensile strain to thereby place faceplate glass surfaces adjacent to said interface under compressive strain to increase the resistance of said faceplate to defects attributable to thermal gradients in the region of said mask support means.

4. The flat tension mask color cathode ray tube defined by claim 3 wherein the contraction coefficient of said first element is no less than three points lower than the contraction coefficient of said faceplate glass, or the tensile strain in said interface glass no less than 2000 psi.

5. The flat tension mask color cathode ray tube defined by claim 4 wherein said cement has a contraction coefficient intermediate that of said faceplate glass and said first element.

6. A flat tension mask color cathode ray tube having a front assembly comprising:

a faceplate having an inner surface with a target area for receiving a cathodoluminescent screen, said faceplate being composed of a glass having a predetermined thermal contraction coefficient; and mask support means secured by devitrifiable solder glass on opposed sides of said target area for receiving and retaining a foil shadow mask in tension at a predetermined distance from said inner surface, said mask support means comprising a ceramic-glass laminate with a ceramic element between the faceplate glass and a metal element, said mask support means having a net thermal contraction coefficient which is lower than said predetermined glass coefficient such that after devitrification of said solder glass at an elevated temperature to affix said mask support means to said faceplate, and subsequent cool-down, faceplate glass at the interface with said mask support means is placed under significant tensile strain to thereby place faceplate glass surfaces adjacent to said interface under compressive strain to increase the resistance of said faceplate to defects attributable to thermal gradients in the region of said mask support means.

7. The flat tension mask color cathode ray tube defined by claim 6 wherein the contraction coefficient of said ceramic element is no less than three points lower than the contraction coefficient of said faceplate glass, or the tensile strain in said interface glass no less than 2000 psi.

8. The flat tension mask color cathode ray tube defined by claim 7 wherein said solder glass has a contraction coefficient intermediate that of said faceplate glass and said ceramic element.

9. A flat tension mask color cathode ray tube having a front assembly comprising:

a faceplate having an inner surface with a target area for receiving a cathodoluminescent screen, said faceplate being composed of a glass having a predetermined thermal contraction coefficient; and mask support means secured by cement on opposed sides of said target area for receiving and retaining a foil shadow mask in tension at a predetermined distance from said inner surface, said mask support means comprising a laminate with a first element between the faceplate glass and a second element, said first element having a contraction coefficient no less than three points lower than that of the faceplate glass, or the tensile strain in said interface glass no less than 2000 psi, and said second element having a contraction coefficient higher than that of said faceplate glass, said mask support means having a net thermal contraction coefficient which is lower than said predetermined glass coefficient such that after devitrification of said cement at an elevated temperature to affix said mask support means to said faceplate, and subsequent cool-down, faceplate glass at the interface with said mask support means is placed under significant tensile strain to thereby place faceplate glass surfaces adjacent to said interface under compressive strain to increase the resistance of said faceplate to defects attributable to thermal gradients in the region of said mask support means, the contraction coefficient of said cement being intermediate that of said faceplate glass and said first element to provide a buffering effect to the thermal expansion differential between said first element and said glass faceplate, said first element having a lengthwise groove at its interface with said faceplate inner surface to accommodate a greater amount of said cement at said interface and thereby improve said buffering effect without increasing the cement-caused separation of said first element from said faceplate inner surface.

10. A flat tension mask color cathode ray tube having a front assembly comprising:

a faceplate having an inner surface with a target area for receiving a cathodoluminescent screen, said faceplate being composed of a glass having a predetermined thermal contraction coefficient; and mask support means secured by a devitrifiable solder glass cement on opposed sides of said target area for receiving and retaining a foil shadow mask in tension at a predetermined distance from said inner surface, said mask support means comprising a laminate with a ceramic first element between the faceplate glass and a second element, said ceramic first element having a contraction coefficient no less than three points lower than that of the faceplate glass, or the tensile strain in said interface glass no less than 2000 psi, and said second element having a contraction coefficient higher than that of said faceplate glass, said mask support means having a net thermal contraction coefficient which is lower than said predetermined glass coefficient such that after devitrification of said cement at an elevated temperature to affix said mask support means to said faceplate, and subsequent cool-down, faceplate glass at the interface with said mask support means is placed under significant tensile strain to thereby place faceplate glass surfaces adjacent to said interface under compressive strain to increase the resistance of said faceplate to defects attributable to thermal gradients in the region of said mask support means, the contraction coefficient of said cement being intermediate that of said faceplate glass and said first element to provide a buffering effect to the thermal expansion differential between said ceramic first element and said glass faceplate, said ceramic first element having a lengthwise groove at its interface with said faceplate inner surface to accommodate a greater amount of said cement at said interface and thereby improve said buffering effect without increasing the cement-caused separation of said ceramic first element from said faceplate inner surface.

11. A tension mask color cathode ray tube having a front assembly including a glass faceplate having on its inner surface a centrally disposed phosphor screen, and a metal foil shadow mask mounted in tension on a mask-support structure located on opposed sides of said screen and secured to said inner surface with devitrifying solder glass having a coefficient of thermal contraction lower than that of said faceplate, said support structure being recessed in its area of securement to said faceplate for receiving and forming a bead of said solder glass effective when said solder glass is devitrified to secure said structure to said faceplate, the coefficient of thermal contraction of said mask support structure being such, relative to that of said faceplate, that the faceplate experiences a residual strain effective to enable said assembly to tolerate wide temperature excursions experienced during production.

12. A front assembly for a tension mask color cathode ray tube having a support structure secured to an inner surface of a front assembly faceplate by a devitrifying solder glass for retaining a foil shadow mask under tension, said support structure having a net coefficient of thermal contraction lower than that of said faceplate and comprising an elongated structure having an upper region remote from said faceplate when mounted thereon for receiving and securing said mask, and a flat surface adapted to interface with said faceplate inner surface, said front assembly being constructed and arranged such that the area of said flat surface of said faceplate interfacing with said support structure is placed in tension so as to place the marginal area of said flat surface of said faceplate adjacent said support structure in compression so as to enable said assembly to tolerate wide temperature excursions experienced during production.

13. The apparatus defined in by claim 12 wherein said mask support structure is secured to said faceplate by means of a solder glass having a coefficient of thermal contraction intermediate that of said mask support structure and said faceplate.

* * * * *